US008091680B2

(12) United States Patent
Killion et al.

(10) Patent No.: US 8,091,680 B2
(45) Date of Patent: Jan. 10, 2012

(54) ACOUSTIC RESISTOR FOR HEARING IMPROVEMENT AND AUDIOMETRIC APPLICATIONS, AND METHOD OF MAKING SAME

(75) Inventors: Mead C. Killion, Elk Grove Village, IL (US); Andrew J. Haapapuro, Schaumburg, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 1705 days.

(21) Appl. No.: 10/901,581

(22) Filed: Jul. 29, 2004

(65) Prior Publication Data

US 2005/0002541 A1 Jan. 6, 2005

Related U.S. Application Data

(62) Division of application No. 10/705,082, filed on Nov. 10, 2003, now Pat. No. 6,830,876, which is a division of application No. 09/767,521, filed on Jan. 23, 2001, now Pat. No. 6,666,295.

(51) Int. Cl.
*H04R 25/02* (2006.01)

(52) U.S. Cl. ..... 181/130; 181/135; 181/286; 181/129; 379/451

(58) Field of Classification Search ..... 181/131, 181/129, 290, 296, 294, 284, 135, 130; 379/451
See application file for complete search history.

(56) References Cited

U.S. PATENT DOCUMENTS

| | | | | |
|---|---|---|---|---|
| 953,557 | A | 3/1910 | Shepart | 181/130 |
| 1,854,830 | A * | 4/1932 | Flanders | 181/294 |
| 3,930,560 | A | 1/1976 | Carlson et al. | 181/130 |
| 3,953,566 | A * | 4/1976 | Gore | 264/505 |
| 4,144,910 | A * | 3/1979 | Bader | 139/91 |
| 4,349,082 | A * | 9/1982 | Gastmeier | 181/130 |
| 4,852,683 | A * | 8/1989 | Killion | 181/130 |
| 4,987,597 | A * | 1/1991 | Haertl | 381/325 |
| 5,401,920 | A * | 3/1995 | Oliveira | 181/135 |
| 5,619,019 | A * | 4/1997 | Yoshimura et al. | 181/166 |
| 5,828,012 | A * | 10/1998 | Repolle et al. | 181/175 |
| 5,920,911 | A * | 7/1999 | Cushman | 2/209 |
| 6,029,769 | A | 2/2000 | Tichy | 181/136 |
| 6,310,961 | B1 * | 10/2001 | Oliveira et al. | 381/328 |
| 6,367,543 | B1 * | 4/2002 | Calaman et al. | 165/80.4 |
| 6,388,231 | B1 * | 5/2002 | Andrews | 219/121.69 |
| 6,512,834 | B1 * | 1/2003 | Banter et al. | 381/386 |
| 6,554,097 | B2 * | 4/2003 | Konig | 181/129 |
| 6,666,295 | B2 * | 12/2003 | Killion et al. | 181/130 |
| 6,691,822 | B2 * | 2/2004 | Meussen et al. | 181/135 |
| 6,932,187 | B2 * | 8/2005 | Banter et al. | 181/149 |
| 7,035,420 | B2 * | 4/2006 | Moquin et al. | 381/355 |

(Continued)

*Primary Examiner* — Forrest M Phillips
(74) *Attorney, Agent, or Firm* — McAndrews, Held & Malloy, Ltd.

(57) ABSTRACT

An acoustic resistor or damper and method of manufacturing the same is disclosed. The damper has mesh material and mounting material attached to the mesh material. The mounting material defines an open region for transmission of sound through the mesh material, and has a mounting surface for mounting the damper on a surface surrounding an acoustic port or tube. The mounting surface is located on a plane different from the mesh material, thereby shielding the mesh material from adhesive applied between the mounting surface and the surface surrounding the acoustic port or tube. The method of manufacturing an acoustic damper comprises a sheet of double-sided tape having at least one perforation applied to a mesh material. The double-sided tape and mesh material is cut in the shape surrounding the at least one perforation.

23 Claims, 7 Drawing Sheets

U.S. PATENT DOCUMENTS

| | | | | |
|---|---|---|---|---|
| 7,240,765 | B2 * | 7/2007 | Berg et al. | 181/135 |
| 2002/0071551 | A1 * | 6/2002 | Lee | 379/451 |
| 2002/0096390 | A1 * | 7/2002 | Killion et al. | 181/129 |
| 2002/0179365 | A1 * | 12/2002 | Meussen et al. | 181/135 |
| 2004/0099578 | A1 * | 5/2004 | Winkler et al. | 209/309 |
| 2004/0157339 | A1 * | 8/2004 | Burke et al. | 436/149 |
| 2005/0000461 | A1 * | 1/2005 | Kincaid | 119/169 |
| 2005/0233132 | A1 * | 10/2005 | Kojima | 428/328 |
| 2006/0042865 | A1 * | 3/2006 | Berg et al. | 181/135 |
| 2006/0198987 | A1 * | 9/2006 | Grob et al. | 428/137 |
| 2006/0209544 | A1 * | 9/2006 | Nishikawa et al. | 362/294 |
| 2006/0245613 | A1 * | 11/2006 | Itoh et al. | 381/388 |

* cited by examiner

ACOUSTIC RESISTOR FOR HEARING IMPROVEMENT AND AUDIOMETRIC APPLICATIONS, AND METHOD OF MAKING SAME

CROSS-REFERENCE TO RELATED APPLICATIONS

The present application is a divisional of prior U.S. application Ser. No. 10/705,082 filed Nov. 10, 2003 now U.S. Pat. No. 6,830,876 which is a divisional of prior U.S. application Ser. No. 09/767,521 filed Jan. 23, 2001, now U.S. Pat. No. 6,666,295 issued Dec. 23, 2003, each of which is incorporated herein by reference in its entirety.

STATEMENT REGARDING FEDERALLY SPONSORED RESEARCH OR DEVELOPMENT

N/A

BACKGROUND OF THE INVENTION

The use of acoustic resistance in transducers and sound channels is well known. In the case of a sound tube, for example, a resistance equal to its characteristic impedance will completely damp the length resonances, leaving a smooth frequency response. This is recently taught, for example, by the inventor in his chapter describing use of dampers entitled ("Earmold Design: Theory and Practice," Proceedings of 13th Danavox Symposium, pp. 155-174, 1988). In the case of microphones and receivers, acoustic resistance can be used to smooth resonance peaks and improve the sound quality (as described by Killion and Tillman in their paper "Evaluation of High-Fidelity Hearing Aids," J. Speech Hearing Res., V. 25, pp. 15-25, 1982). In the case of earplugs, acoustic resistance can be used in cooperation with other acoustic elements to produce high fidelity earplugs such as used by musicians in symphony orchestras (as cited in the following: Carlson, 1989, U.S. Pat. No. 4,807,612; Killion, 1989, U.S. Pat. No. 4,852,683; Killion, Stewart, Falco, and Berger, 1992, U.S. Pat. No. 5,113,967).

One problem, however, with available acoustic resistors, commonly called dampers or damping elements, is their cost. When produced with adequately tight tolerance such as to +/−20% or better, the most popular damping elements (Knowles BF-series plugs, Carlson and Mostardo, 1976, U.S. Pat. No. 3,930,560) cost $0.60 each even in very high quantities. This has been relatively stable over the life of the U.S. Pat. No. 3,930,560 and has been independent of whether the actual damping element is a cloth mesh, perforated metal (typically electroformed), or the like.

Another problem with available acoustic resistors is their design. FIG. 1 illustrates a typical early prior art acoustic resistor design. Resistor (damper) 100 is comprised of a flat piece of cloth (e.g., silk) punched into a cloth disc 101. Cloth disc 101 is mounted on a flat surface over an acoustic port or tube 103. Typically, non-corrosive rubber-like adhesive 105, for example, is used between a bottom surface of cloth disc 101 and a top surface of the structure that forms port or tube 103. Portions of the adhesive 105 typically wick into areas of the open region of cloth disc 101, as shown by reference numerals 107 and 109.

FIGS. 2A and 2B illustrate a later prior art acoustic resistor design. FIG. 2A is a side view of a damper 200, which is comprised of a flat piece of metal 203 that has perforated holes 205 in the middle. The perforated holes 205 form the open region of the damper 201. FIG. 2B is another review of the damper of FIG. 2A. As can be seen, the damper 201 is generally comprised of a perforated center section 207 (i.e., the open region) and a solid outer ring 209.

Like damper 100, damper 200 is mounted on a flat surface over an acoustic tube or port (not shown). Adhesive is likewise used between a surface of the solid outer ring 209 and a top surface of the structure that forms the tube or port. Again, portions of the adhesive wick into the perforated center section 207, partially deforming the open region of the damper 200.

In both cases, this wicking effect causes a change in the diameter of the open region of the damper, which consequently causes a change in the resistance of the damper. A 2% change in the diameter of the open region of the damper causes an approximately 4% change in the resistance of the damper. Because the diameter of the port or tube of prior art devices was typically large, however, changes in the diameter of the damper as such had at least a tolerable adverse effect on damper performance.

As the port and tube diameters of hearing improvement and audiometric devices become smaller and smaller, however, the adverse effect of adhesive wicking becomes more pronounced. In order to obtain tight tolerances of resistance values as port and tube diameters decrease, it is desirable to more tightly control the open region of the damper by eliminating adhesive wicking. On the other hand, in order to provide inexpensive assembly, adhesive is generally used. The combination of small dampers and the use of adhesive, however, causes highly variable results.

Further limitations and disadvantages of conventional and traditional systems will become apparent to one of skill in the art through comparison of such systems with the present invention set forth in the remainder of the present application with reference to the drawings.

BRIEF SUMMARY OF THE INVENTION

The problems and drawbacks of the prior art are addressed by the damper of the present invention. The damper comprises a mesh material and a mounting material that is attached to the mesh material. The mounting material defines an open region of the mesh material through which sound is transmitted. The mounting material has a mounting surface that is located on a different plane than the mesh material. This configuration enables adhesive to be used between the mounting surface of the damper and a corresponding mounting surface surrounding an acoustic opening, without effecting the resistance of the mesh material in the open region.

The mesh material may be, for example, cloth, metal, polyester, nylon or silk. The mounting material may be emulsion or double-sided tape, for example.

In an emulsion embodiment, the damper may be manufactured by applying a photosensitive emulsion over the mesh material and exposing the emulsion through a photographic mask. The exposed emulsion is washed away, leaving an open region of mesh and a surround of emulsion. The surround of emulsion (and mesh) is then mechanically punched to generate a "doughnut" damper, or any other desired shape, having an open region of mesh defined by surrounding emulsion.

In a double-sided tape embodiment, the damper may be manufactured by applying a sheet of perforated double-sided tape to a mesh material. The double-sided tape surrounding the perforation is then mechanically punched to generate a finished damper product (after removal of the double-sided tape backing), having an open region of mesh defined by surrounding double-sided tape.

Other aspects, advantages and novel features of the present invention will become apparent from the following detailed description of the invention when considered in conjunction with the accompanying drawings.

DETAILED DESCRIPTION OF THE INVENTION

Figure 1:
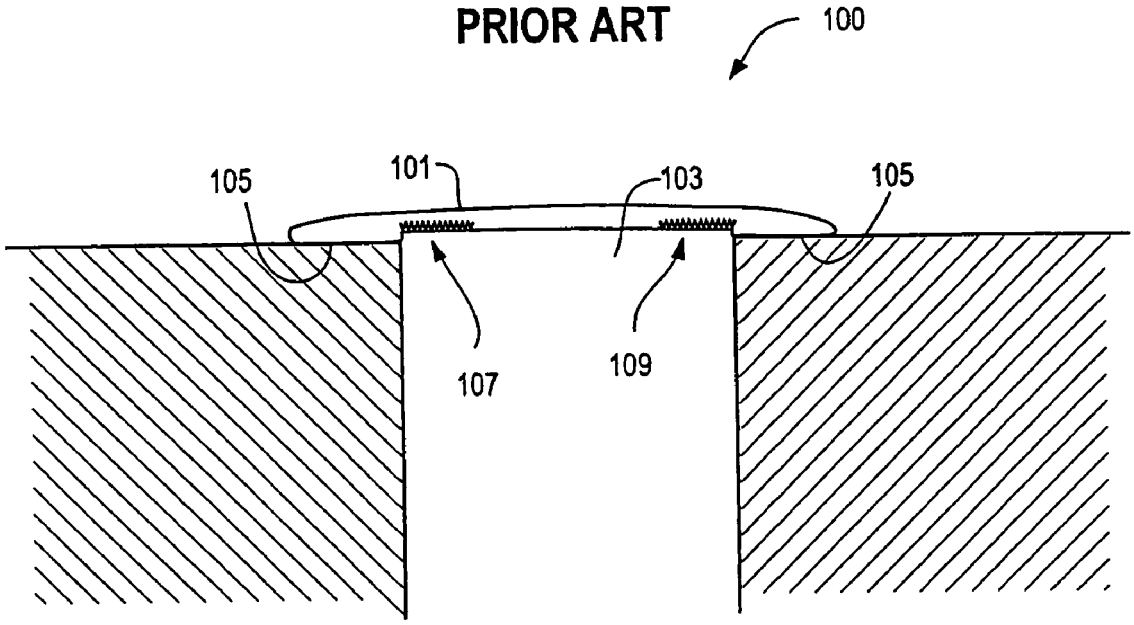
Fig. 1 PRIOR ART
FIG. 1 illustrates a typical early prior art acoustic resistor design.
Figure 2A:
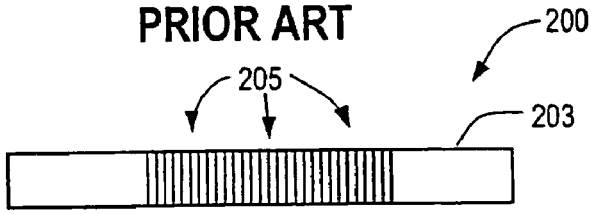
Fig. 2A PRIOR ART
FIG. 2A and 2B illustrate a later prior art acoustic resistor design.
Figure 2B:
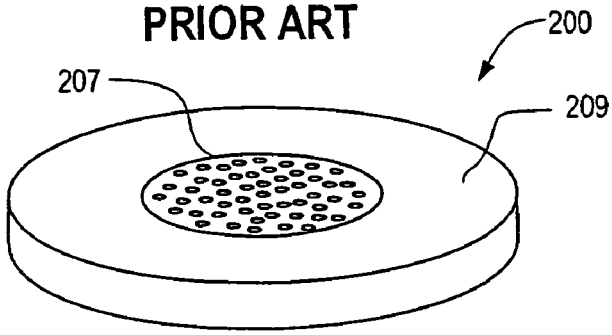
Fig. 2B PRIOR ART
Figure 3A:
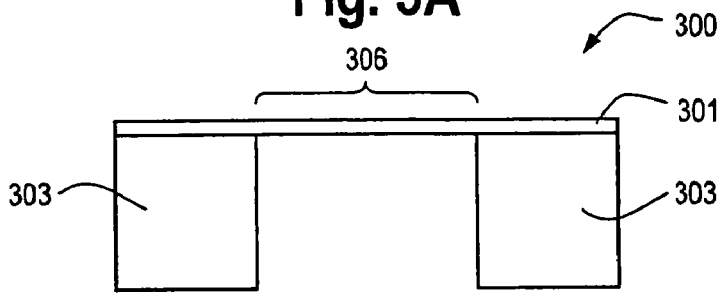
FIG. 3A is a cross-sectional view of an acoustic resistor or damper according to the present invention.

FIG. 3A is a cross-sectional view of an acoustic resistor or damper according to the present invention. Damper 300 comprises a mesh material 301 and a mounting material 303. The mesh material 301 may be, for example, cloth, metal, polyester, nylon, or silk, and may have a thickness chosen to suit the particular application. In one hearing aid application, a thickness of approximately 0.003 inches was found to be acceptable. The mounting material 303 may be, for example, emulsion, double-sided tape, or foam, and may also have a thickness chosen to suit the particular application. In the hearing aid application mentioned above, a thickness of approximately 0.002 inches was found to be acceptable. In another application, a thickness of approximately 0.020 was found acceptable. Mounting material 303 is mounted or attached to mesh material 301, forming open region 306 of the damper 300.

Figure 3B:
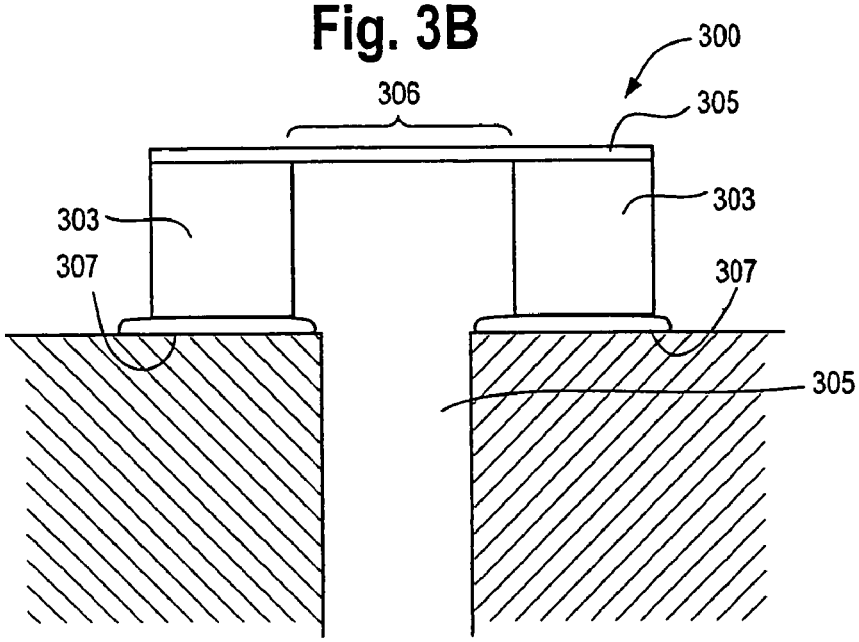
FIG. 3B is a cross-sectional view of the acoustic resistor or damper mounted on a flat surface and over an acoustic port or tube.

FIG. 3B is a cross-sectional view of the acoustic resistor or damper 303 mounted on a flat surface and over an acoustic port or tube 305. Adhesive 307 is used between the flat surface and mounting material 303. Adhesive 307 may, for example, be epoxy.

As can be seen from FIG. 3B, the surface of the mounting material 303 that receives the adhesive 307 is on a different plane than mesh material 301. Thus, the open region 306 of the damper 300 is positioned away from the adhesive 307. Any wicking of the adhesive 307 occurs in the mounting material 303, and consequently the open region is not affected. This configuration enables tight tolerances of the resistance values from one specimen to the next.

Figure 4:
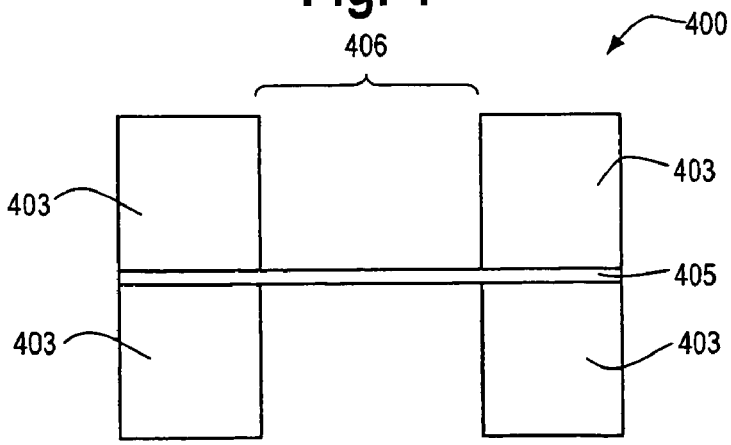
FIG. 4 is a cross-section view of an alternate embodiment of the acoustic resistor or damper of FIG. 3A.

FIG. 4 is a cross-section view of an alternate embodiment of the acoustic resistor or damper of FIG. 3A. Acoustic resistor or damper 400 is similar to damper 300 of FIG. 3A, except that mounting material 403 of FIG. 4 is mounted or attached on both sides of mesh material 405. This enables adhesive to be used on both sides of the damper 400, if desired for a particular mounting configuration, without affecting the open region 406 of damper 400.

Figure 5A:
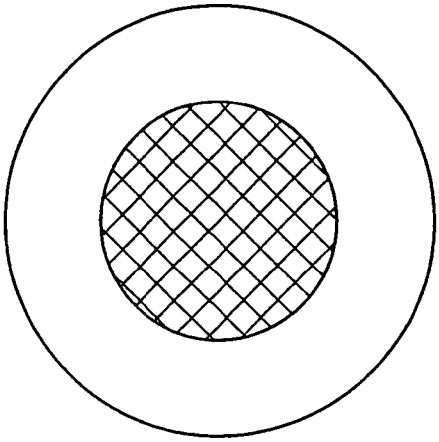
FIGS. 5A-5C are top views of various contemplated shapes that the acoustic resistor or damper of the present invention may take to fit a number of different applications.
Figure 5B:
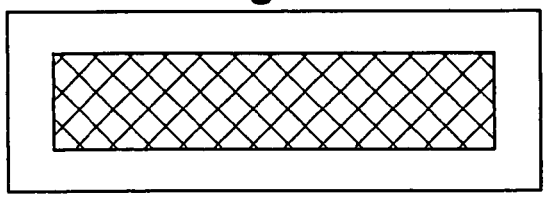
Figure 5C:
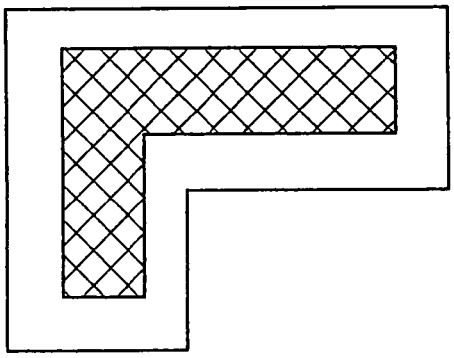

The acoustic resistors or dampers of FIGS. 3A and 4 may be formed into any shape, and may have nearly any desired dimensions to enable use with nearly any size or shape acoustic port or tube. For example, FIGS. 5A-5C are top views of various contemplated shapes that the acoustic resistor or damper of the present invention may take to fit a number of different applications. More specifically, FIG. 5A is a "doughnut" or generally circular shape, which may be used with, for example, generally circular port openings. FIG. 5B is a generally rectangular shape, which may be used with, for example, generally rectangular port openings. FIG. 5C is a "corner" shape, which may be used in an application in which the acoustic port opening is located on a corner. Of course, any number of other shapes may also be used and are contemplated by the present invention.

Figure 6:
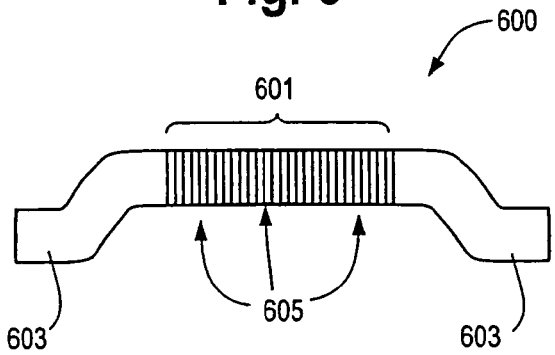
FIG. 6 is a cross-sectional view of another alternate embodiment of the acoustic resistor or damper of the present invention.

FIG. 6 is a cross-sectional view of another alternate embodiment of the acoustic resistor or damper of the present invention. Damper 600 may be, for example, a formed disc made from metal via a photo etching process. Damper 600 comprises an open region 601 and an adhesive portion or surface 603. The open region 601 may comprise a plurality of perforated holes 605, for example. Like the embodiments of FIGS. 3A and 4 discussed above, the mounting surface 603, as a result of the forming, is located on a different plane than the open region 601. Consequently, adhesive may be used between the mounting surface 603 and a flat surface surrounding the acoustic port or opening (not shown) without affecting the open region 601.

Figure 7A:
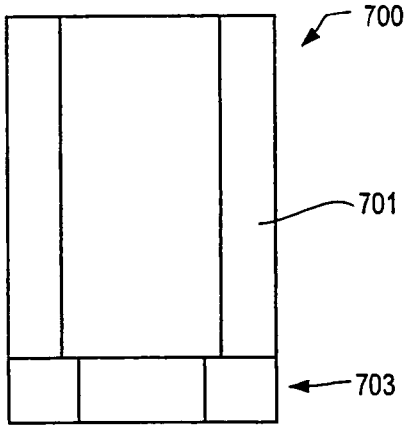
FIGS. 7A and 7B are cross-sectional views of embodiments of an acoustic resistor or damper assembly of the present invention, for mounting on or within an acoustic port or tube.
Figure 7B:
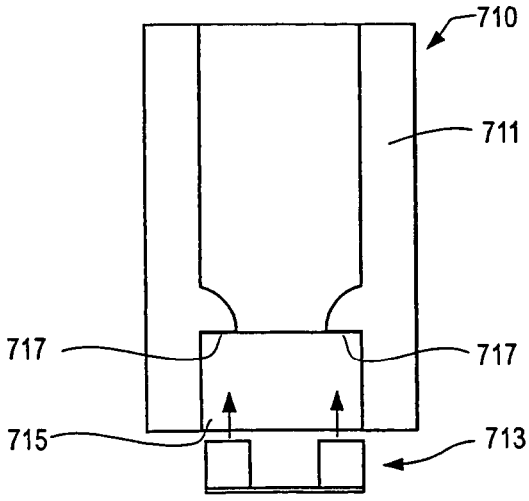

FIGS. 7A and 7B are cross-sectional views of embodiments of an acoustic resistor or damper assembly of the present invention, for mounting on or within an acoustic port or tube. Damper assembly 700 of FIG. 7A comprises a body piece 701 and a damper piece 703. Damper piece 703 may be, for example, that described above with respect to FIG. 3A or FIG. 4, and body piece 701 may be molded from plastic. Damper piece 703 is mounted on an end surface of body piece 701, and the assembly 700 is inserted as a unit into an acoustic port or tube (not shown).

Similarly, damper assembly 710 of FIG. 7B comprises a body piece 711 and a damper piece 713. Again damper piece 713 may be, for example, that described above with respect to FIG. 3A or FIG. 4, and body piece 711 may be molded from plastic. In the embodiment of FIG. 7B, however, body piece 711 includes a recess 715 and a mounting surface 717 for receiving and mounting the damper piece 713 within the body piece 711. Once the damper piece 713 is mounted within the body piece 711, the damper assembly 710 is inserted as a unit on or into an acoustic port or tube (not shown). The damper piece 713 can be sealed within the body piece 711 by several means. For, example, the sides of body piece 711 defining the recess 715 may be crimped. Alternately, a sealing collar (not shown) can be pressed into the recess 715 and against the damper piece 713. Otherwise, adhesive can be used.

The damper assembly embodiments of FIGS. 7A and 7B may be used as a lower cost replacement for insertion-type prior art dampers, such as, for example, the cup-like acoustic resistor found in U.S. Pat. No. 3,930,560 mentioned above.

As mentioned above with respect to FIGS. 3A and 4, the mounting material may be made of a number of different materials, such as double-sided tape or emulsion. In an emulsion embodiment, a thick photosensitive emulsion is applied over the resistance material and then exposed through a photographic mask so as to allow washing out of the emulsion in the desired resistance area (i.e., the "open region" discussed above) leaving a surround of thick emulsion. The desired form or shape (e.g., the "doughnut" shape discussed above) is then punched or cut out to produce the finished damper product.

More specifically, a photographic mask is prepared that defines the inner diameter of the desired opening (i.e., the "open region" discussed above). Any shape or size of the open region may be selected depending on the application (as mentioned above), and the selected shape and size is replicated (typically by a photographic "step and repeat" process). Cloth or mesh material is then obtained having the desired resistance value, and is mounted on a frame (such as a silk screen frame, for example). Emulsion is then applied to the cloth. The emulsion can be applied to the top (or bottom) of the screen only (to obtain the configuration shown in FIG. 3A), or to both the top and bottom of the screen (to obtain the configuration shown in FIG. 4).

Figure 8:
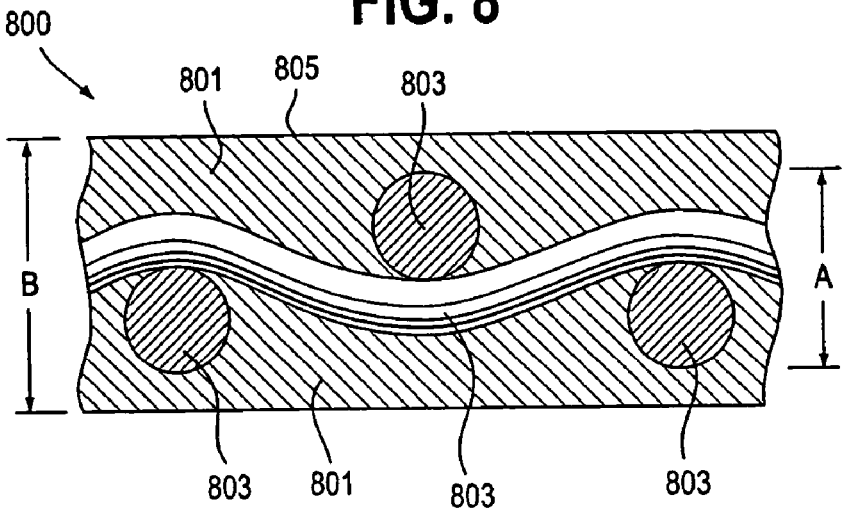
FIG. 8 is a side view illustrating an emulsion/mesh combination used in connection with manufacture of one embodiment of the damper of the present invention.

FIG. 8 is a side view illustrating the resulting emulsion/mesh combination at this stage of the process. Combination 800 comprises emulsion 801 and cloth weave 803. The cloth weave 803 may have a thickness of approximately 0.0025 to 0.003 inches (dimension A in FIG. 8), and may be comprised of double twill polyester. The emulsion may have an approximately flat surface 805 (for mounting), and may be approximately 0.005 inches thick (dimension B in FIG. 8).

Figure 9:
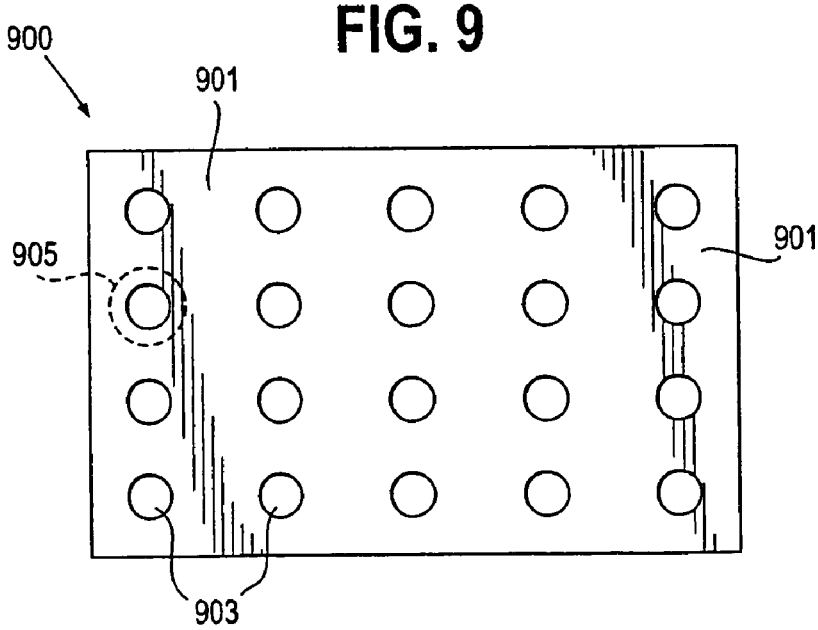
FIG. 9 is a top view of a matrix of nearly finished dampers manufactured according to one embodiment of the method of the present invention.

Next, the emulsion is exposed through the mask to ultraviolet light, and the exposed emulsion is washed away to define those portions of the emulsion to be removed from the cloth. With appropriate changes to the photographic mask, either a positive or negative resist may be used. In other words, a matrix of nearly finished dampers (inner diameters only) results. FIG. 9 is a top view illustrating an example of such a matrix for a "doughnut" shape damper. Matrix 900 comprises emulsion 901 and a plurality of cloth areas 903 (i.e., open regions discussed above).

Finally, the damper outer diameter (see reference numeral 905 in FIG. 8) is mechanically punched out (or cut out using a laser, for example) to achieve the finished damper product. This is done for each of the open regions shown in the matrix 900, to produce a plurality of finished damper products.

Figure 10A:
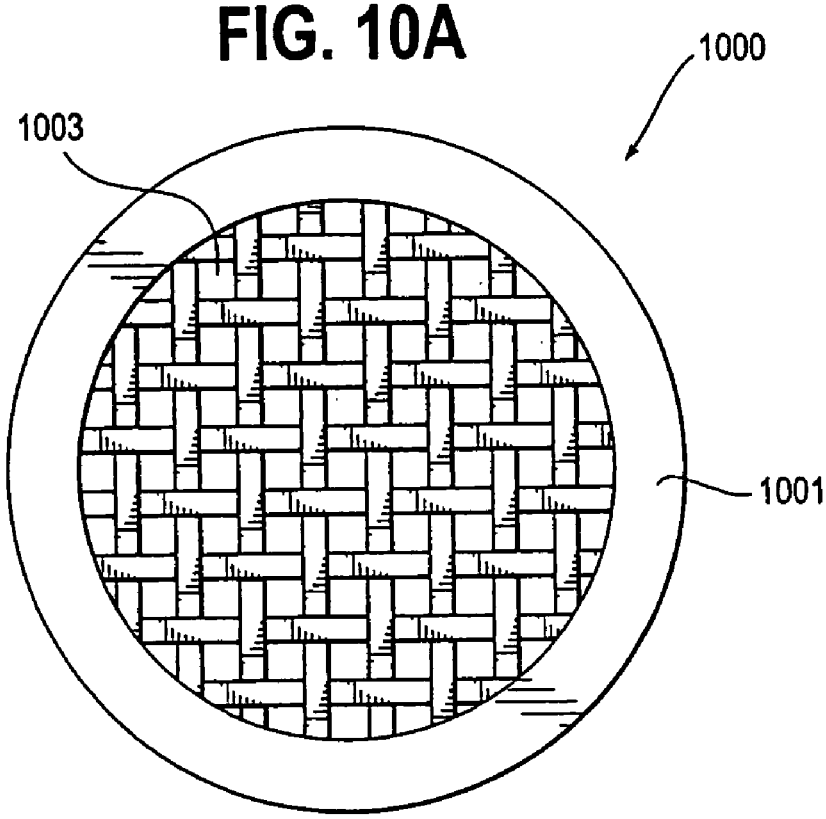
FIG. 10A is a top view of an exemplary finished damper product.
Figure 10B:
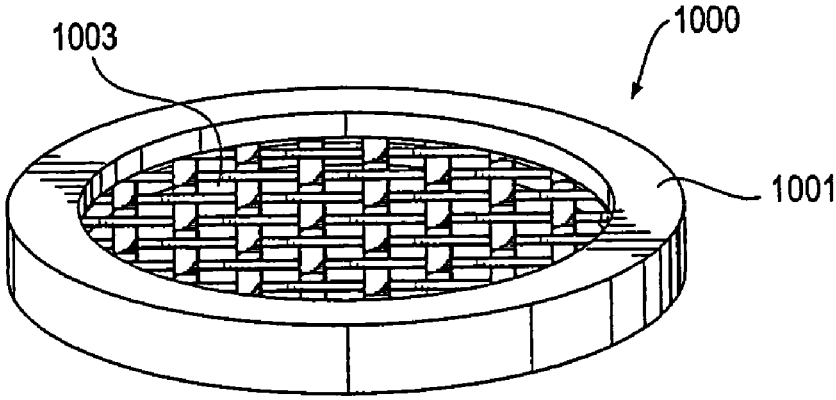
FIG. 10B is a perspective view of an exemplary finished damper product.

FIG. 10A is a top view, and FIG. 10B is a perspective view, of an exemplary finished damper product. Damper 1000 comprises an emulsion mounting portion 1001 and an open mesh region 1003. Damper 1000 may have, for example, an inner diameter (defining the open mesh region 1003) of approximately 0.044 to 0.054 inches, and an outer diameter of approximately 0.078 inches.

Figure 11A:
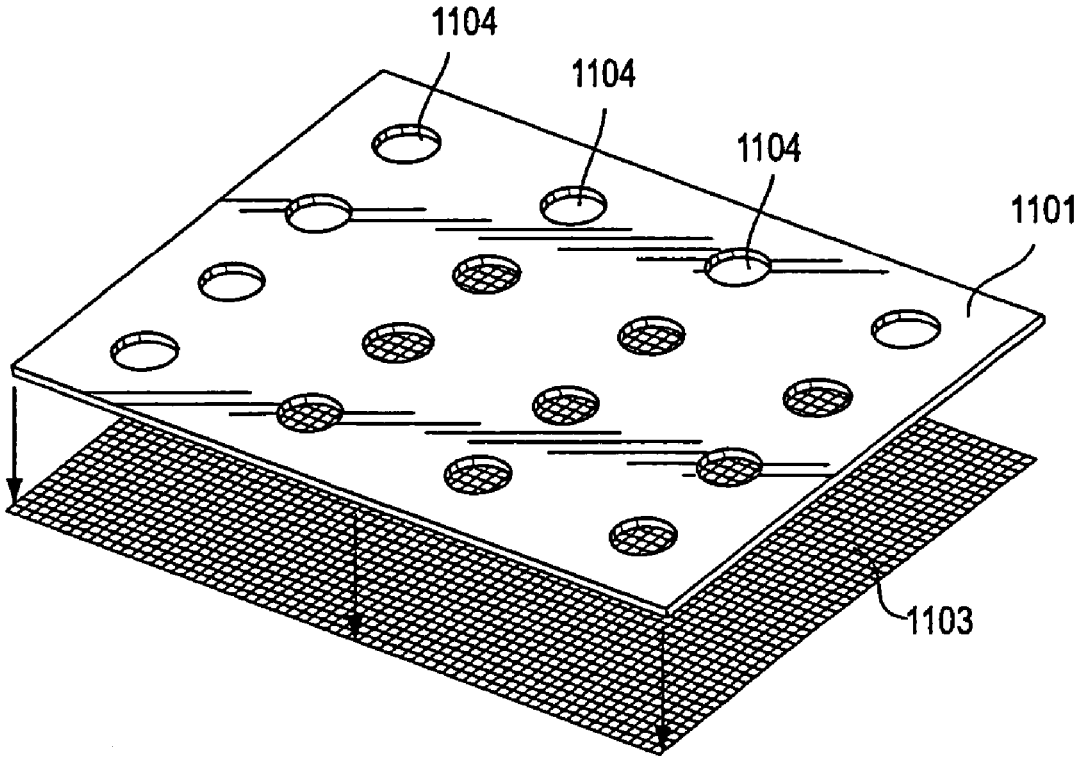
FIGS. 11A and 11B illustrate one embodiment of a "peel, stick and punch" process for making a double-sided tape version of the damper of the present invention.
Figure 11B:
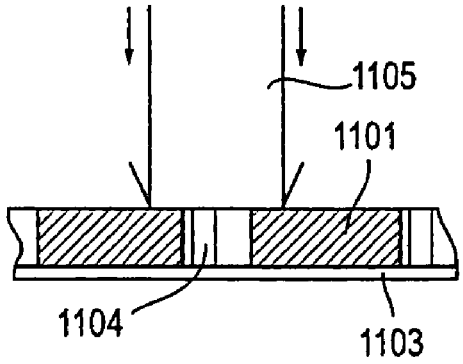

As mentioned above, the dampers shown in FIGS. 3A and 4 may also have a mounting material comprising double-sided tape. FIGS. 11A and 11B illustrate one embodiment of a "peel, stick and punch" process for making a double-sided tape version of the damper of the present invention. First, a sheet of perforated double-sided tape 1101 is applied to a sheet of cloth or metal mesh 1103. The perforations 1104 in the double-sided tape 1101 define the inner diameter of a plurality of unfinished dampers. Next, a mechanical punch (reference numeral 1105 in FIG. 11B) is used to punch through the double-sided tape 1101 and the cloth or metal mesh 1103, defining the outer diameter and creating the finished product.

Figure 12A:
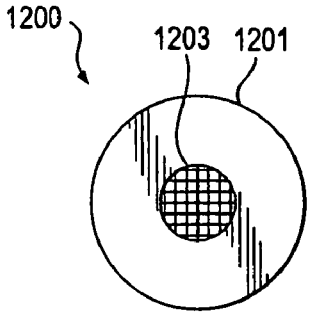
FIGS. 12A and 12B illustrate one potential finished product that may be made using the process discussed with respect to FIGS. 11A and 11B.
Figure 12B:
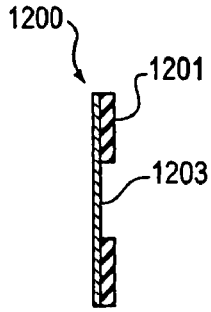

FIGS. 12A and 12B illustrate one potential finished product that may be made using the process discussed above with respect to FIGS. 11A and 11B. FIG. 12A is a top view and FIG. 12B is a side cross-sectional view. Damper 1200 comprises a mounting portion 1201 made of double-sided tape and a screen or mesh portion 1203 made of polyester, for example. The damper 1200 may have an inner diameter of approximately 0.045 inches and an outer diameter of approximately 0.120 inches, for example.

In an alternate embodiment, the finished damper of FIGS. 12A and 12B may instead be made by a different process. Specifically non-perforated double-sided tape is applied directly to a sheet of cloth or metal mesh. A laser beam is then used to cut the inner diameter through the double-sided tape (but not the cloth or metal mesh), and the resulting slug is removed. Finally, a mechanical punch (such as shown in FIG. 11B) is used to punch through the double-sided tape and the cloth or metal mesh, defining the outer diameter and creating the finished product.

Figure 13A:
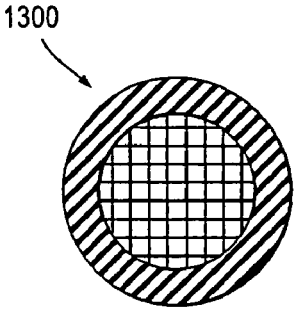
FIGS. 13A and 13B are top and side cross-sectional views, respectively, of an alternate double-sided tape embodiment.
Figure 13B:
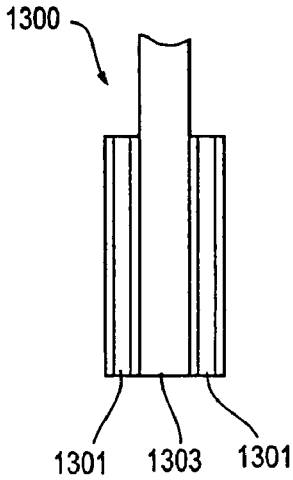

FIGS. 13A and 13B are top and side cross-sectional views, respectively, of an alternative double-sided tape embodiment. Similarly as discussed above with respect to FIG. 4, damper 1300 of FIGS. 13A and 13B comprises double-sided tape 1301 attached to both sides of cloth or mesh material 1303. The processes discussed above with respect to FIG. 11A and 11B, with slight modification, may be used to manufacture the finished product shown in FIGS. 13A and 13B. For example, two perforated sheets of double-sided tape may be attached to the mesh or screen (one on each side), before the punch process is undertaken.

Figure 14A:
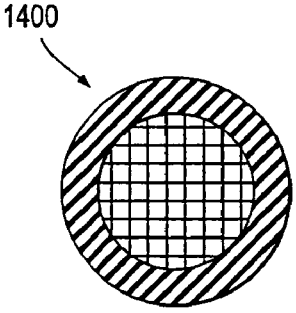
FIGS. 14A and 14B are top and side cross-sectional views, respectively, of another alternative double-sided tape embodiment.
Figure 14B:
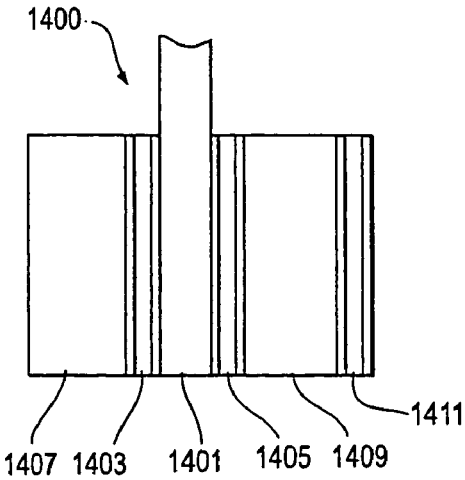

FIGS. 14A and 14B are top and side cross-sectional views, respectively, of another alternative double-sided tape embodiment. FIGS. 14A and 14B are similar to FIGS. 13A and 13B, except that a sheet of foam is placed on each side of the double-sided tape, and an additional piece of double-sided tape is placed on a surface of one of the foam sheets. Specifically, as can be seen from FIG. 14B, damper 1400 comprises a polyester cloth 1401, double-sided tape 1403 and 1405 on respective sides of the polyester cloth 1401, foam 1407 and 1409 on respective sides of the double-sided tape 1403 and 1405, and finally a further piece of double-sided tape 1411 on the other surface of foam 1409. Again, the processes discussed above respecting the other double-sided tape embodiments may be used, with slight modification, to produce the finished product shown in FIGS. 14A and 14B.

The dampers of the present invention permit tight tolerances of the resistance values even when adhesives are used. In addition, the dampers of the present invention can be made in large numbers relatively easily and inexpensively. In fact, Applicant believes that the dampers of the present invention can be manufactured and sold at a price that is orders of magnitude cheaper (e.g., 5 cents) than the prior art (e.g., 60 cents).

Many modifications and variations of the present invention are possible in light of the above teachings. Thus, it is to be understood that, within the scope of the appended claims, the invention may be practiced otherwise than as described hereinabove.

What is claimed and desired to be secured by letters patent is:

1. A method of manufacturing an acoustic damper for use in hearing improvement and audiometric devices comprising:

applying a sheet of double-sided tape having at least one perforation to a mesh material forming an open region of the acoustic damper for transmission of sound; and cutting the double-sided tape and mesh material in a shape surrounding the at least one perforation.

2. The method of claim 1 further comprising cutting the at least one perforation in the double-sided tape.

3. The method of claim 1 wherein cutting the double-sided tape and mesh material comprises mechanically punching a shape surrounding the at least one perforation.

4. The method of claim 1 further comprising removing backing material of the double-sided tape.

5. A method of manufacturing at least one acoustic damper for use in hearing improvement and audiometric devices comprising:

applying a double-sided first material to a second material, wherein said double-sided first material defines an open region of said second material for transmission of sound; and cutting said double-sided first material forming the at least one acoustic damper and said second material.

6. The method of claim 5 comprising defining an inner diameter of the at least one acoustic damper using at least one perforation formed in said double-sided first material.

7. The method of claim 6 wherein said at least one perforation defines an inner diameter of the at least one acoustic damper of approximately 0.045 inches.

8. The method of claim 5 comprising defining an outer diameter of the at least one acoustic damper by cutting said at least said double-sided first material and said second material.

9. The method of claim 8 wherein said cutting at least said double-sided first material and said second material defines an outer diameter of the at least one acoustic damper of approximately 0.120 inches.

10. The method of claim 5 comprising removing a backing material from said double-sided first material prior to applying it to said second material.

11. The method of claim 5 wherein said double-sided first material comprises a double-sided tape having a plurality of perforations.

12. The method of claim 5 wherein said second material comprises at least one of a cloth, mesh, metal, polyester, nylon and silk.

13. The method of claim 5 wherein said cutting at least said double-sided first material comprises mechanically punching through said double-sided first material and said second material in a predefined shape surrounding at least one perforation formed in said double-sided first material.

14. The method of claim 5 wherein said cutting at least said double-sided first material comprising cutting said double-sided first material using a laser.

15. The method of claim 14 comprising removing a plug formed by cutting said double-sided first material using said laser, defining an inner diameter of the at least one acoustic damper.

16. The method of claim 15 comprising mechanically punching through said double-sided first material and said second material in a predefined shape, defining an outer diameter of the at least one acoustic damper.

17. A method of manufacturing a plurality of acoustic dampers for use in hearing improvement and audiometric devices comprising:

removing a backing from at least one side of a double-sided tape material;

applying said double-sided tape material to a mesh material, wherein said double-sided tape material defines a plurality of open regions of said mesh material for transmission of sound; and cutting said mesh material and said double-sided tape material forming the plurality of acoustic dampers.

18. The method of claim 17 comprising defining an inner diameter of the plurality of acoustic dampers using a plurality of perforations formed in said double-sided tape material.

19. The method of claim 17 wherein said mesh material comprises at least one of a cloth, metal, polyester, nylon and silk.

20. The method of claim 17 wherein said cutting at least said double-sided tape material comprises mechanically punching through said double-sided tape material and said mesh material in a predefined shape surrounding a plurality of perforations formed in said double-sided tape material.

21. The method of claim 17 wherein said cutting at least said double-sided tape material comprises cutting said double-sided tape material using a laser.

22. The method of claim 21 comprising removing a plug formed by cutting said double-sided tape material using said laser, defining an inner diameter of the plurality of acoustic dampers.

23. The method of claim 22 comprising mechanically punching through said double-sided tape material and said mesh material in a predefined shape, defining an outer diameter of the plurality of acoustic dampers.

* * * * *